US010767292B2

(12) United States Patent
Imano et al.

(10) Patent No.: US 10,767,292 B2
(45) Date of Patent: Sep. 8, 2020

(54) SEWING MACHINE

(71) Applicant: JUKI CORPORATION, Tama-shi, Tokyo (JP)

(72) Inventors: Takashi Imano, Tama (JP); Makoto Yokota, Tama (JP)

(73) Assignee: JUKI CORPORATION, Tama-shi, Tokyo (JP)

( * ) Notice: Subject to any disclaimer, the term of this patent is extended or adjusted under 35 U.S.C. 154(b) by 93 days.

(21) Appl. No.: 15/993,979

(22) Filed: May 31, 2018

(65) Prior Publication Data

US 2018/0347087 A1 Dec. 6, 2018

(30) Foreign Application Priority Data

Jun. 1, 2017 (JP) ..... 2017-108915

(51) Int. Cl.

| | |
|---|---|
| ***D05B 19/14*** | (2006.01) |
| ***D05B 1/00*** | (2006.01) |
| ***D05B 21/00*** | (2006.01) |
| ***D05B 69/02*** | (2006.01) |
| ***D05B 69/18*** | (2006.01) |
| ***D05B 97/02*** | (2006.01) |

(52) U.S. Cl.

CPC ..... *D05B 19/14* (2013.01); *D05B 1/00* (2013.01); *D05B 21/00* (2013.01); *D05B 69/02* (2013.01); *D05B 69/18* (2013.01); *D05B 97/02* (2013.01)

(58) Field of Classification Search

CPC .... D05B 19/00–16; D05B 1/00; D05B 21/00; D05B 69/02; D05B 69/18; D05B 69/20; D05B 69/24; D05B 69/30; D05B 97/02

See application file for complete search history.

(56) References Cited

U.S. PATENT DOCUMENTS

| | | | | |
|---|---|---|---|---|
| 4,534,304 | A * | 8/1985 | Reinke | D05B 69/20 112/315 |
| 4,583,476 | A * | 4/1986 | Fischer | D05B 69/20 112/272 |
| 4,602,577 | A * | 7/1986 | Kothe | D05B 69/20 112/272 |
| 2007/0221108 | A1* | 9/2007 | Koerner | D05B 11/00 112/119 |
| 2016/0153129 | A1* | 6/2016 | Takizawa | D05C 7/00 112/102.5 |

FOREIGN PATENT DOCUMENTS

JP 4724938 B2 7/2011

* cited by examiner

*Primary Examiner* — Ismael Izaguirre

(74) *Attorney, Agent, or Firm* — Faegre Drinker Biddle & Reath LLP

(57) ABSTRACT

A sewing machine of the present embodiment comprises a movement amount detector which detects a movement amount of fabric, a sewing machine motor serving as a rotary drive source of an upper shaft which applies vertical movement to a needle bar, a shaft angle detector which detects a shaft angle of an output shaft of the upper shaft or the sewing machine motor, and a controller which controls the sewing machine motor based on the detection of the movement amount detector and performs controls of maintaining a constant stitch length. The controller performs controls of maintaining the constant stitch length, by a movement amount of the fabric detected by the movement amount detector in a shaft angle section where a sewing needle is not stuck into a cloth, based on the detection by the shaft angle detector.

6 Claims, 7 Drawing Sheets

SEWING MACHINE

CROSS-REFERENCE TO RELATED APPLICATIONS

The present application claims the benefit of priority of Japanese Patent Application No. 2017-108915, filed on Jun. 1, 2017, the content of which is incorporated herein by reference.

TECHNICAL FIELD

The present invention relates to a sewing machine that detects an amount of movement of fabric relative to the sewing machine.

BACKGROUND ART

A sewing machine has been known which maintains a constant stitch length, by determining the amount of movement of the fabric on a throat plate by an optical sensor fixedly mounted on a frame of a sewing machine, and by controlling the rotational speed of a sewing machine motor so that the stitch is performed with a fixed amount of movement, are known (see, for example, Japanese Patent Application No. 4724938).

However, in the sewing machine of the related art, as illustrated in FIG. 7A, when a sewing needle 112 is positioned above the fabric, a sensor 121 can correctly detect the movement amount m of the fabric C. However, when the sewing needle 112 is stuck into the fabric C, since the movement of the fabric C is restricted, the sensor 121 cannot accurately detect the movement amount of the fabric.

In particular, when the sewing needle 112 passes through the bottom dead center and moves upward, as illustrated in FIG. 7B, since the fabric C is pulled up together with the sewing needle 112, a movement component mf is generated in the fabric C, and the sensor 121 further degrades the detection precision of the movement amount of the fabric.

SUMMARY OF THE INVENTION

An object of the present invention is to provide a sewing machine that can detect the movement amount of a fabric for avoiding the influence of the stitch of the fabric. The sewing machine of the present invention has the following characteristics (1) to (4).

(1) A sewing machine comprising:

a movement amount detector which detects a movement amount of fabric;

a sewing machine motor serving as a rotary drive source of an upper shaft which applies vertical movement to a needle bar;

a shaft angle detector which detects a shaft angle of an output shaft of the upper shaft or the sewing machine motor; and a controller which controls the sewing machine motor based on the detection of the movement amount detector and performs controls of maintaining a constant stitch length, wherein the controller performs controls of maintaining the constant stitch length, by a movement amount of the fabric detected by the movement amount detector in a shaft angle section where a sewing needle is not stuck into a cloth, based on the detection by the shaft angle detector.

(2) The sewing machine according to (1), wherein the controller is able to set a range of a predetermined upper shaft angle as a non-detection section, among the shaft angle sections where the sewing needle is not stuck into the cloth, and performs controls of maintaining the constant stitch length, by the movement amount of the fabric detected by the movement amount detector in a section where the sewing needle is excluded from the non-detection section is not stuck into the cloth.

(3) The sewing machine according to (1), wherein free motion stitching is performed by manually moving the fabric with respect to a stitch position of the sewing machine.

(4) The sewing machine according to (2), wherein free motion stitching is performed by manually moving the fabric with respect to a stitch position of the sewing machine.

(5) The sewing machine according to (1), wherein the free motion stitching is performed by manually moving the sewing machine with respect to the fabric.

(6) The sewing machine according to (2), wherein the free motion stitching is performed by manually moving the sewing machine with respect to the fabric.

In the sewing machine having at least one of the above characteristics (1) to (6), since the controller performs controls of maintaining a constant stitch length based on the movement amount of the fabric detected in the shaft angle section when the sewing needle is not stuck into the cloth, it is possible to more precisely detect the movement amount of the fabric and to perform sewing, while more accurately maintaining the constant stitch length.

DETAILED DESCRIPTION

Outline of Embodiment of the Invention

Figure 1:
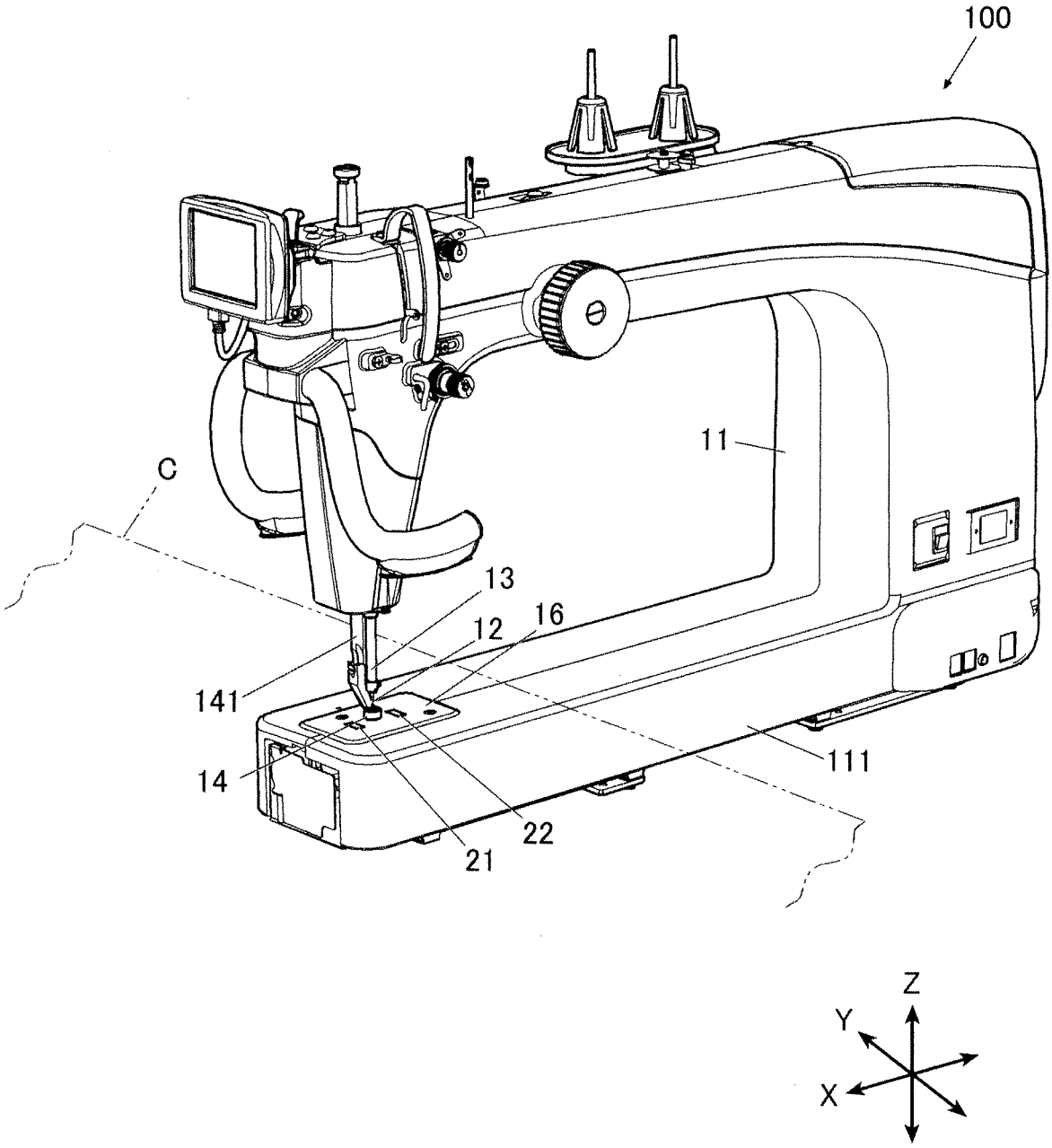
FIG. 1 is a perspective view of a sewing machine according to an embodiment of the present invention.
Figure 2:
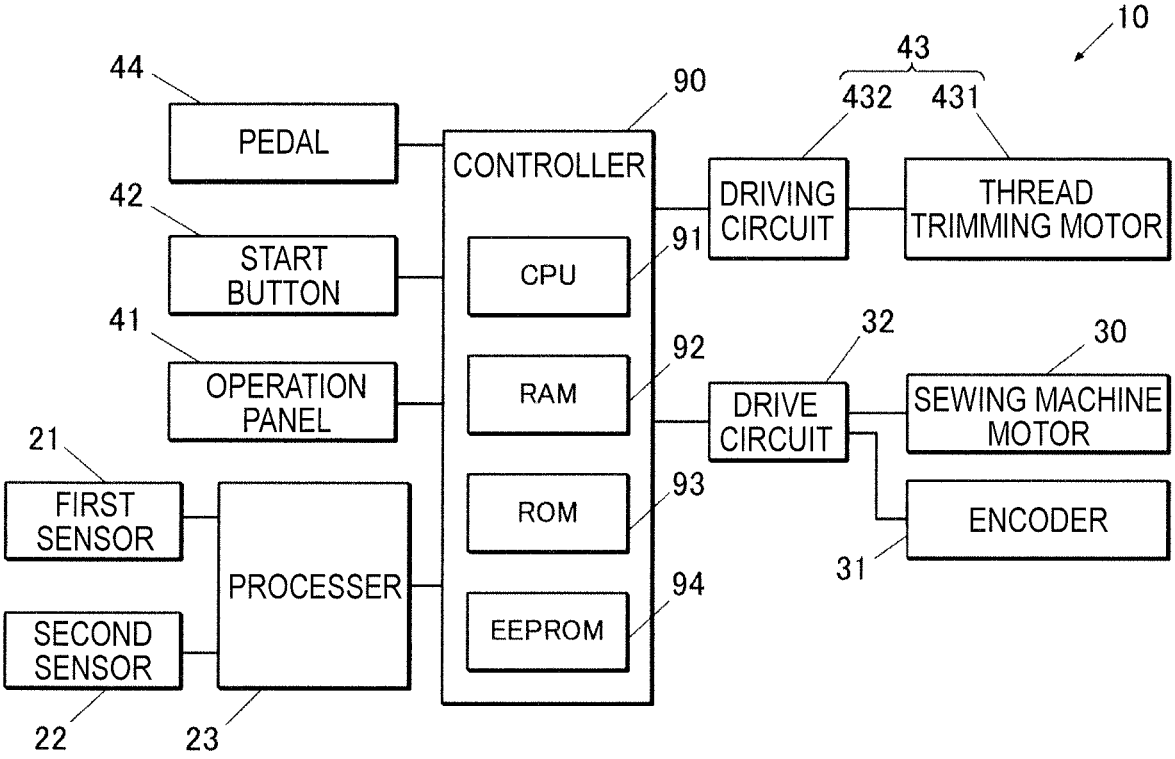
FIG. 2 is a block diagram illustrating a control system of the sewing machine.

Hereinafter, a sewing machine according to the present invention will be described with reference to the drawings. FIG. 1 is a perspective view of the sewing machine 100, and FIG. 2 is a block diagram illustrating a control system of the sewing machine 100.

The sewing machine 100 according to the present embodiment is a so-called free motion stitching machine in which a worker freely moves the cloth C as fabric held on a dedicated holding base by a manual operation, and sewing is performed, while relatively positioning the cloth C relative to the stitch position.

In the present embodiment, since the illustration of the holding base and the explanation of the structure thereof are the same as well-known holding bases, they will be omitted.

The sewing machine 100 includes a needle bar up-down moving mechanism for vertically moving the needle bar 13 for holding the sewing needle 12 at the lower end portion, a shuttle mechanism for catching needle thread passed through the sewing needle 12 and tangling with the needle thread, a thread take-up lever mechanism for pulling up the upper thread to form a nodule, a thread tensioner for applying a predetermined tension to the upper thread, a sewing machine frame 11 for storing or holding the thread tensioner, and a controller 90 as a control unit for controlling the operation of each portion.

Since the shuttle mechanism, the thread take-up lever mechanism and the thread tensioner are the same as well-known configurations in the sewing machine, a detailed explanation will be omitted.

The sewing machine frame 11 includes a sewing machine bed portion located at the lower portion of the sewing machine body, a standing portion standing from one end portion of the sewing machine bed portion, and a sewing machine arm portion extending from the standing portion in the same direction as the sewing machine bed portion.

In the following description, a direction along a longitudinal direction of the sewing machine bed portion 111 in a horizontal direction is defined as an X axis direction, a direction orthogonal to the X axis direction in the horizontal direction is defined as a Y axis direction, and a vertical direction orthogonal to the X axis direction and the Y axis direction is defined as a Z axis direction.

The needle bar up-down moving mechanism includes a sewing machine motor 30 serving as a driving source of the sewing operation, an upper shaft (not illustrated) which is rotationally driven by the sewing machine motor 30, and a clutch mechanism (not illustrated) which converts the torque of the upper shaft into upper and lower reciprocating motions and applies to the needle bar 13.

An output shaft of the sewing machine motor 30 is equipped with an encoder 31 as a shaft angle detector, and performs a pulse output according to the shaft angle change amount of the output shaft.

The transmission ratio from the output shaft of the sewing machine motor 30 to the upper shaft is known, and the controller 90 calculates the shaft angle of the output shaft of the sewing machine motor 30 from the pulse output of the encoder 31, and can further calculate the shaft angle of the upper shaft from the transmission ratio.

Further, an encoder may be provided on the upper shaft to directly detect the shaft angle of the upper shaft.

Further, the sewing machine 100 is provided with an intermediate presser 14 which presses the cloth C so that it can smoothly escape from the cloth C when the sewing needle 12 rises. The intermediate presser 14 is supported by the lower end portion of the intermediate bar 141. The intermediate presser 14 is formed as a small frame body capable of loosely inserting the sewing needle 12, obtains power from a sewing machine motor 30 (see FIG. 2) which is a drive source for vertically moving the needle bar 13 via a well-known transmission mechanism, and moves up and down with an amplitude smaller than that of the needle bar 13. It should be noted that the intermediate presser 14 is out of phase with the needle bar 13, and the intermediate presser 14 descends when the sewing needle 12 ascends. Further, the intermediate presser 14 is set so that a certain gap is formed between the throat plate 16 and at the bottom dead center position so as not to hinder the movement of the cloth C.

Further, as illustrated in FIG. 2, the sewing machine 100 includes a thread trimmer 43 for cutting thread at the time of completion of sewing. The thread trimmer 43 includes a movable knife capable of performing a reciprocating rotation so as to pass under an eye on the lower side of the throat plate 16, a fixed knife for cutting the sewing the thread by cooperation with the moving knife (both are not illustrated), a thread trimming motor 431 for reciprocally rotating the moving knife, and a driving circuit 432 for driving the thread trimming motor 431 in accordance with a command from the controller 90.

In the sewing machine bed portion 111, on the both sides of the eye (not illustrated) of the throat plate 16 in the X axis direction, in the vicinity of the stitch position of the sewing machine 100 with respect to the cloth C manually fed, first and second sensors 21 and 22 serving as a movement amount detector for detecting the relative movement amount in the horizontal plane (X-Y plane) are provided, respectively.

These first and second sensors 21 and 22 are two-dimensional image sensors fixedly mounted in a state of being directed upward from the upper surface of the throat plate 16.

Further, the first and second sensors 21 and 22 are arranged so that their optical axes are parallel to the Z axis direction and are symmetrical with respect to a plane including the center line of the needle bar 13.

The resolution of these sensors 21 and 22 is 3 [μm]. In addition, the respective sensors 21 and 22 detect the lower surface of the cloth C on the throat plate 16 as needed, and input the detection data to the adjoining processer 23.

The numerical values of the resolutions of the sensors 21 and 22 are merely examples and are not limited to the above numerical values.

The processer 23 attached to the first and second sensors 21 and 22 inputs the pulse signal to the controller 90 whenever a change of resolution of 3 [μm] is generated with respect to the movement amount of the cloth C, from continuous detection signals that are input from time to time from each of the sensors 21 and 22.

It is to be noted that the processer 23 previously determines one of the first and second sensors 21 and 22 as the main and the other as the sub, inputs the pulse signal based on the detection of the main sensor to the controller 90, and inputs a pulse signal based on the detection of the sub sensor to the controller 90 when an error occurs in the main sensor.

Control System of Sewing Machine

The sewing machine 100 includes the controller 90 that controls the operation of each component, and the sewing machine motor 30 and the encoder 31 thereof are connected to the controller 90 via a drive circuit 32.

Further, the thread cutting motor 431 of the above-described thread trimmer 43 is connected to the controller 90 via a drive circuit 432, and the first and second sensors 21 and 22 are connected via the processer 23.

An operation panel 41 serving as an operation unit for an operator of the sewing machine to input an operation to the sewing machine, a start button 42 for starting sewing, and a pedal 44 for driving the sewing machine motor 30 are connected to the controller 90, respectively via an interface (not illustrated).

From the operation panel 41, for example, the stitch length which is a seam length for each stitch is set. Further, a display unit is provided on the operation panel 41, and various kinds of information are displayed.

The controller 90 mainly includes a CPU 91 for controlling the sewing machine motor 30, a RAM 92 serving as a work area of the CPU 91, a ROM 93 for storing a program processed by the CPU 91, and an EEPROM 94 as a storage unit in which data used for calculation processing is stored and which is configured to be capable of rewriting the data.

Operation Control When Sewing

Next, a sewing operation control performed by the controller 90 of the sewing machine 100 will be described.

As described above, in the sewing machine 100, sewing is performed, while the sewing worker moves the cloth C arbitrarily with respect to the stitch position.

When the cloth C is arbitrarily moved by the hand of the sewing machine operator, the controller 90 controls the rotational speed of the sewing machine motor 30 such that the sewing is performed while maintaining the set stitch length set from the operation panel 41.

That is, the controller 90 calculates the movement speed of the cloth C from the time interval (referred to as a pulse interval) of the pulse inputted based on the detection of the first or second sensors 21 and 22, and further calculates the rotational speed of the sewing machine motor 30 for the upper shaft to make one rotation until the movement by the set stitch length at the movement speed is performed, and controls so as to achieve the rotational speed. The calculation of the rotational speed of the sewing machine motor 30 based on the detection by the first sensor 21 or the second sensor 22 is repeatedly executed at a minute time period By the way, during the period from when the sewing needle 12 sticks the cloth C until it is completely removed, the movement of the cloth C is restrained by the sewing needle 12, making it difficult to obtain the movement speed of the cloth C accurately.

Figure 3:
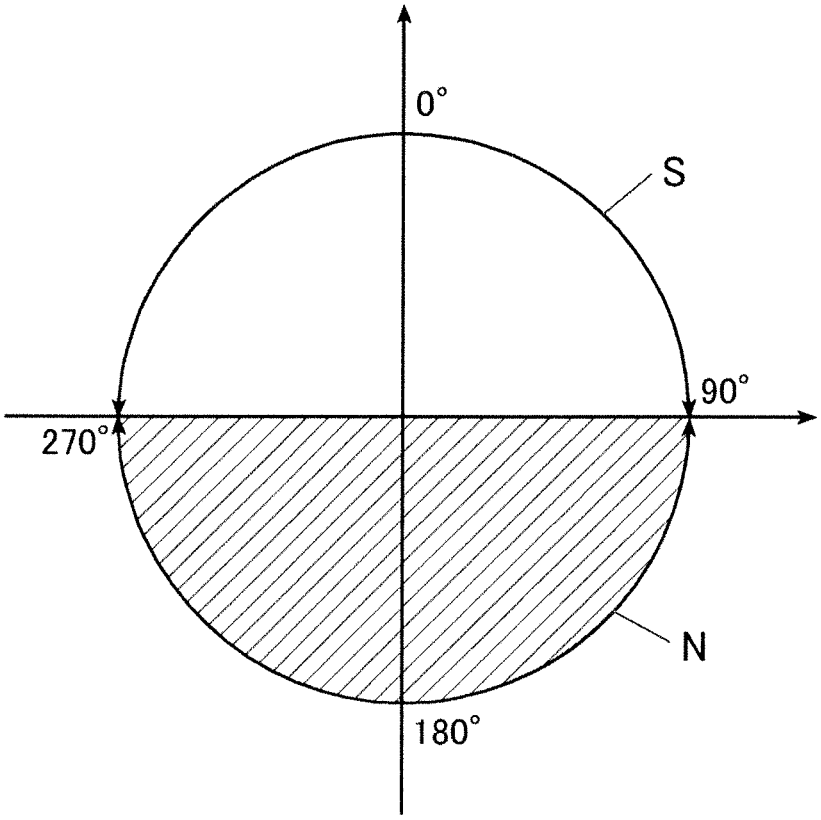
FIG. 3 is an explanatory view illustrating a range of an upper shaft angle which is the detection section for obtaining the output of each sensor.

FIG. 3 is an explanatory view illustrating the upper shaft angle until the descending the sewing needle 12 reaches the throat plate 16 and the sewing needle 12 rising while passing through the needle bar bottom dead center reaches the throat plate 16, the upper shaft angle as the needle bar top dead center is 0° and the upper shaft angle as the needle bar bottom dead center is 180°.

As illustrated in the drawing, the upper shaft angle at which the descending sewing needle 12 reaches the throat plate 16 is 90°, and the upper shaft angle at which the sewing needle 12 rising through the needle bar bottom dead center reaches the throat plate 16 is 270°.

Therefore, the controller 90 avoids the shaft angle section (a non-detection section N) of the upper shaft angle of not less than 90° and not more than 270°, which makes it difficult to accurately obtain the movement speed of the cloth C, and determines the movement speed of the cloth C from the time interval of the pulse input from the processer 23 of the first sensor 21 or the second sensor 22 in a shaft angle section (a detection section S) of the upper shaft angle of more than 270° and less than 90°.

The "detection section" means an upper shaft angle section for controlling the rotational speed of the sewing machine motor 30 based on the detection by the first sensor 21 or the second sensor 22, and the "non-detection section" means an upper shaft angle section that controls the rotational speed of the sewing machine motor 30 without being based on the detection of the first sensor 21 or the second sensor 22.

In this case, the movement speed of the cloth C cannot be obtained during the non-detection section N of the upper shaft angle. Therefore, the controller 90 controls the rotational speed of the sewing machine motor 30, regarding that the cloth C is moving at the movement speed of the cloth C in the non-detection section N and the movement speed obtained just before entering the non-detection section N.

It should be noted that the movement speed of the cloth C in the non-detection section N may not be the movement speed of the cloth C just before entering the non-detection section N, but other reasonable values may be adopted. For example, an average value of movement speeds of a plurality of cloth C calculated in the detection section S may be adopted.

Furthermore, the speed obtained by multiplying the movement speed of the cloth C just previously obtained or the movement speed of the averaged cloth C by a predetermined coefficient may be used as the movement speed of the cloth C in the non-detection section N, thereby controlling the rotational speed of the sewing machine motor 30.

Figure 4:
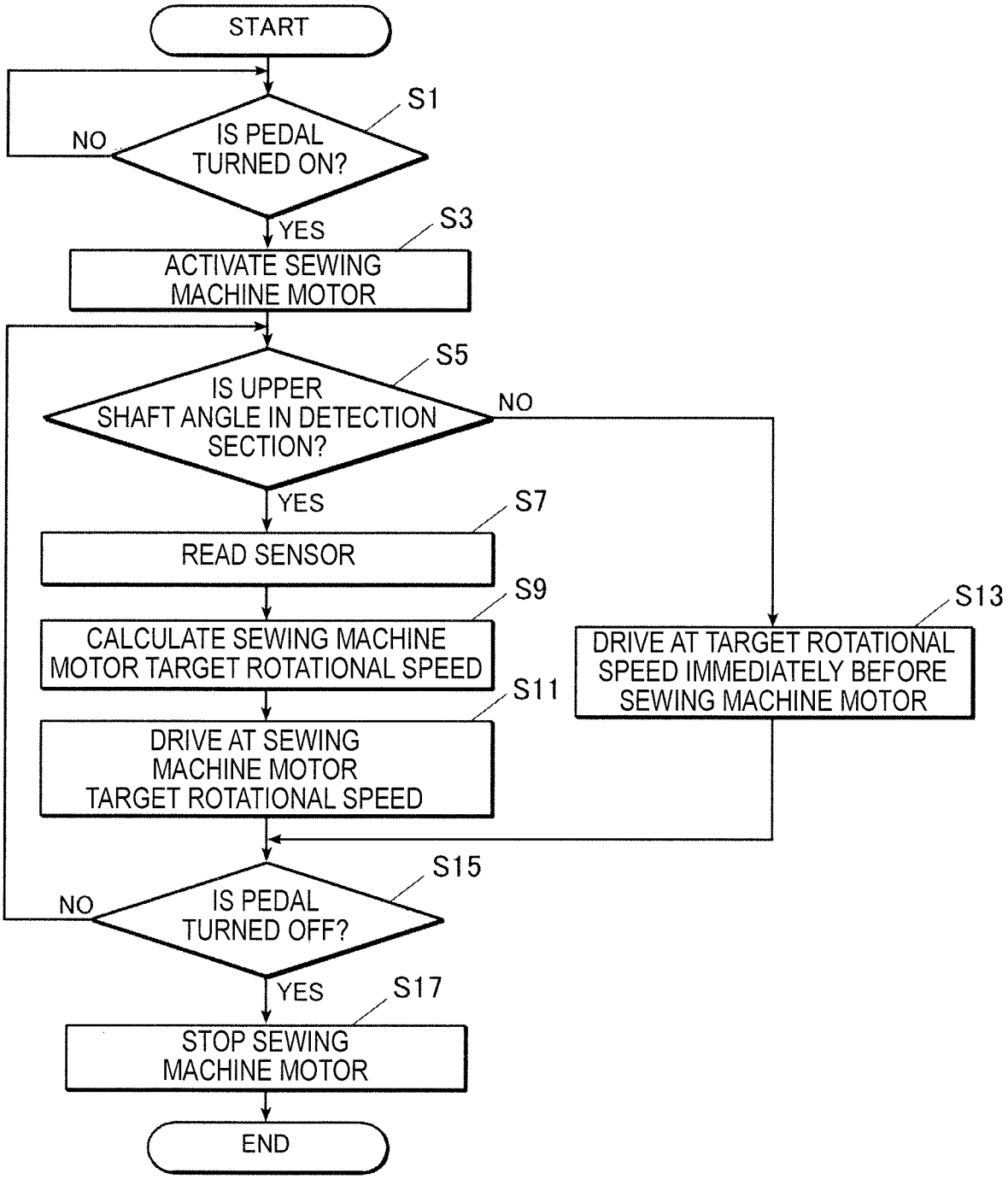
FIG. 4 is a flowchart illustrating the operation control at the time of sewing by the controller.

FIG. 4 is a flowchart illustrating processing executed by the CPU 91 of the controller 90 during sewing. Based on this, the process executed by the CPU 91 at the time of sewing will be described in detail.

Initially, the CPU 91 first detects a depression of the pedal 44 (step S1). If it is not detected, the CPU 91 detects the depression of the pedal 44 again (step S1: NO). When detecting the depression of the pedal 44 (step S1: YES), driving of the sewing machine motor 30 is started (step S3).

The CPU 91 determines from the output of the encoder 31 whether or not the upper shaft angle is within the detection section S (step S5). When the upper shaft angle is within the detection section S (step S5: YES), the CPU 91 calculates the movement speed of the cloth C from the time intervals of the pulses of the first and second sensors 21 and 22 (step S7), and calculates the rotational speed of the sewing machine motor 30 corresponding to the movement speed (step S9). Further, the CPU 91 controls the sewing machine motor 30 so as to achieve the calculated rotational speed (step S11).

Thereafter, the process proceeds to step S15.

On the other hand, when determining that the output of the encoder 31 is out of the detection section S (step S5: NO), the CPU 91 controls the sewing machine motor 30 so as to obtain the latest rotational speed calculated within the detection section S (step S13).

Thereafter, the process proceeds to step S15.

In step S15, the depression of the pedal 44 is detected. When the depression of the pedal 44 is continued (step S15: NO), the process returns to step S5 and whether or not the upper shaft angle is within the detection section S is determined again.

Further, when the depression of the pedal 44 is released (step S15: YES), the CPU 91 stops the sewing machine motor 30 and the operation control ends.

Technical Effect of Embodiment of the Invention

In the sewing machine 100, based on the detection by the encoder 31 serving as the shaft angle detector, the controller 90 performs controls of maintaining the constant stitch length, by the movement amount of the cloth C detected by the first or second sensor 21, 22 as the movement amount detector in the detection section S which is the shaft angle section when the sewing needle 12 is not stuck into the cloth C.

For this reason, it is possible to control the sewing machine motor 30 by reducing the influence of the inaccurate movement amount of the cloth C detected in the non-detection section N which is the shaft angle section when the sewing needle 12 sticks the cloth C, and it is possible to perform sewing by more accurately maintaining the target stitch length.

Therefore, in the case of performing free motion stitching by manually moving the cloth C like the sewing machine 100, it is possible to improve particularly the sewing quality.

Regarding the Range of Detection Section of Upper Shaft Angle

Figure 5:
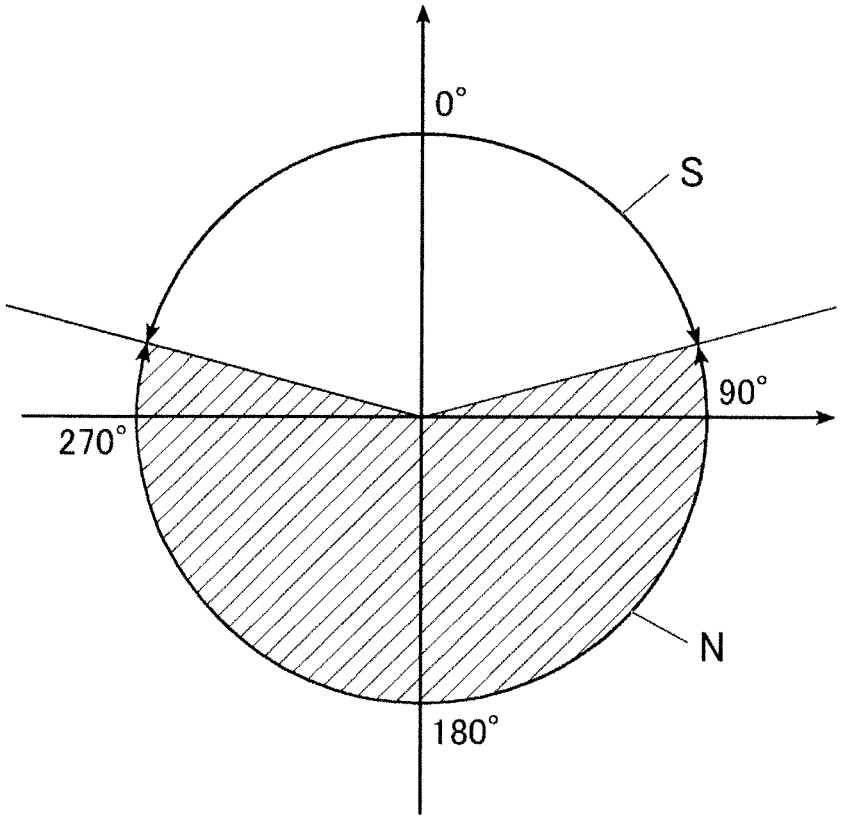
FIG. 5 is an explanatory view illustrating another example of the detection section.

The setting of the detection section S is not limited to the section between 90° and 270° illustrated in FIG. 3, and may be a narrower range. In the present embodiment, the upper shaft angle range in which the sewing needle 12 is located below the throat plate 16 is defined as the section after the sewing needle 12 sticks the cloth C until the complete removal, but as illustrated in FIG. 5, for example, the range of the upper shaft angle where the sewing needle 12 is higher than the throat plate 16 may be set as the detection section S in consideration of the thickness of the cloth C.

In addition, the number of detection section S is not limited to one, and a plurality of detection section S may be set. For example, when the upper shaft angle at which the detection accuracy of the movement speed of the cloth C decreases is known, for example, theoretically or empirically, other than the range of the upper shaft angle in which the sewing needle 12 is sticking the cloth C, such a range of the upper shaft angle may be set as a new non-detection section, and a plurality of detection sections may be provided accordingly.

Figure 6:
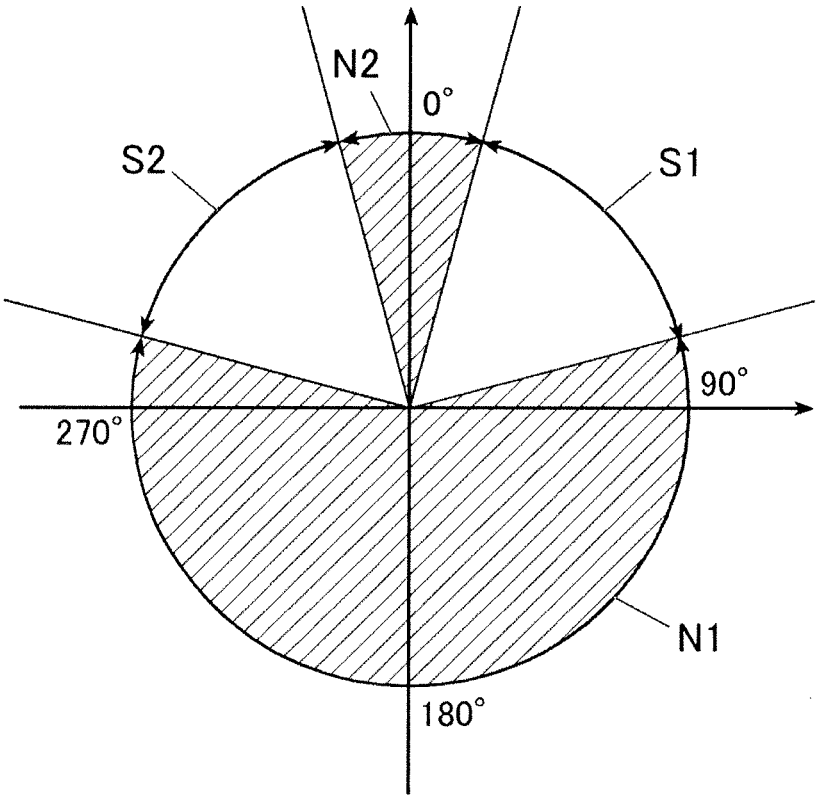
FIG. 6 is an explanatory view illustrating further example of the detection section.
Figure 7A:
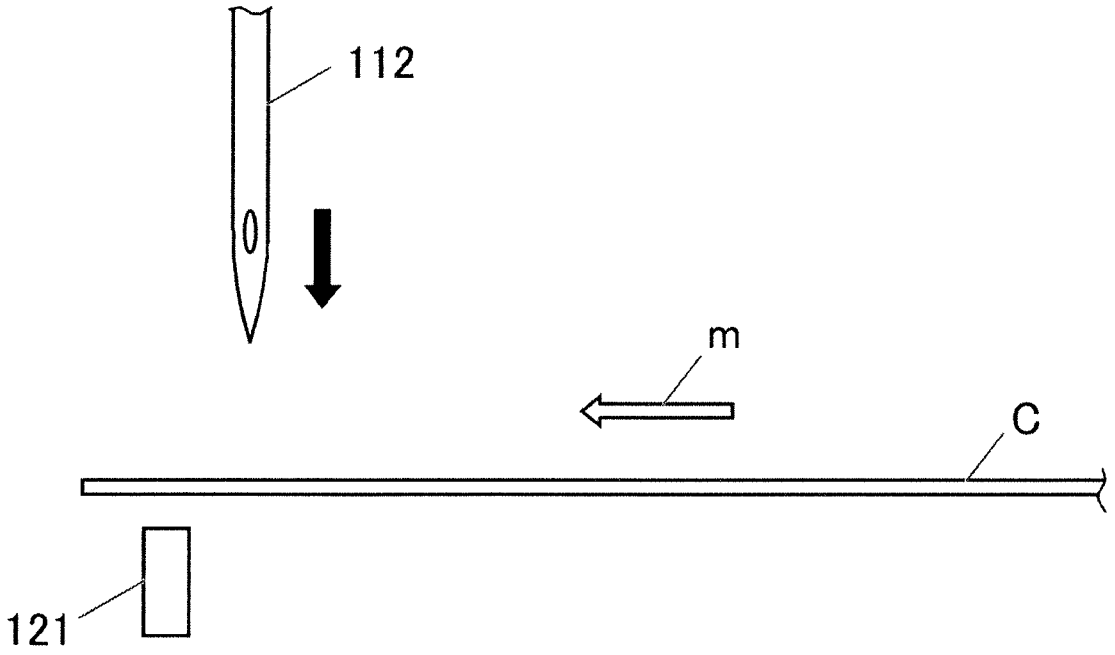
FIG. 7A illustrates the state of movement of the cloth when the sewing needle is not stuck into the cloth.
Figure 7B:
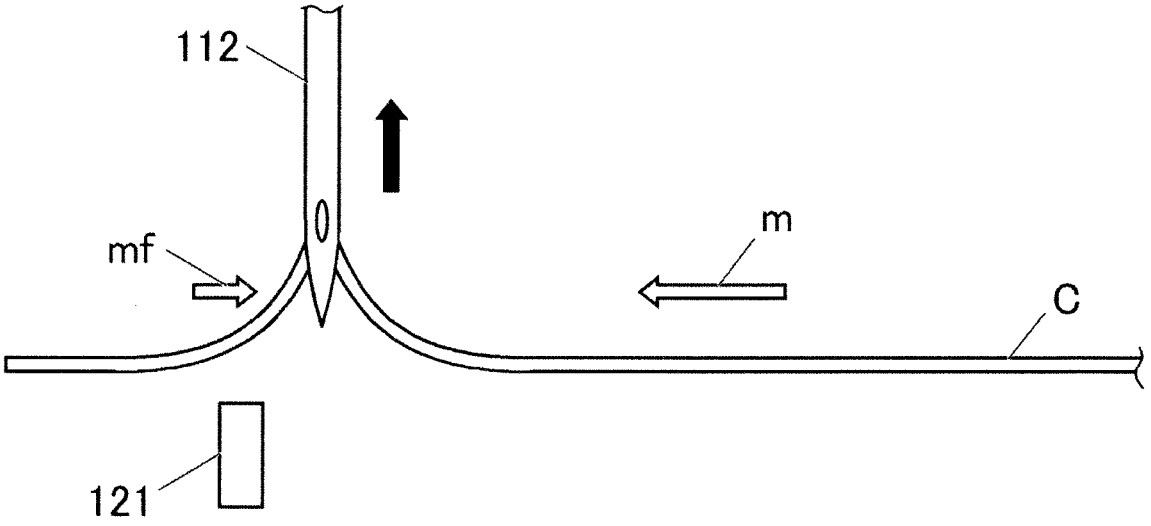
FIG. 7B is an explanatory view illustrating the state of movement of the cloth when the sewing needle is stuck into the cloth.

For example, when it is known that disturbance occurs in the detection movement speed of the cloth C around the top dead center of the sewing needle 12, as illustrated in FIG. 6, the upper shaft angle at which the sewing needle 12 sticks the cloth C is set as the first non-detection section N1, and the periphery of the top dead center of the sewing needle 12 is set as the second non-detection section N2. The upper shaft angle between the first non-detection section N1 and the second non-detection section N2 may be set as the first detection section S1 and the second detection section S2.

As a result, sewing can be performed while controlling the sewing machine motor 30 by reducing the influence of an incorrect movement amount of the cloth, and maintaining the target stitch length more accurately.

Further, the range of an arbitrary upper shaft angle may be set as the non-detection section within the range of the upper shaft angle at which the sewing needle 12 is not stuck into the cloth C by the setting means such as the operation panel 41. Also, the number of detectors may be arbitrarily set.

Others

A case where the above-mentioned sewing machine 100 manually moves the cloth C relative to the sewing machine 100, but it is needless to say that a sewing machine that performs free motion stitching by manually moving the sewing machine 100 with respect to the cloth C may be adopted.

The invention claimed is:

1. A sewing machine comprising:

a movement amount detector which detects a movement amount of fabric;

a sewing machine motor serving as a rotary drive source of an upper shaft which applies vertical movement to a needle bar;

a shaft angle detector which detects a shaft angle of an output shaft of the upper shaft or the sewing machine motor; and a controller which controls the sewing machine motor based on the detection of the movement amount detector and performs controls of maintaining a constant stitch length, wherein the controller performs controls of maintaining the constant stitch length, by a movement amount of the fabric detected by the movement amount detector in a shaft angle section only where a sewing needle is not stuck into a cloth, based on the detection by the shaft angle detector.

2. The sewing machine according to claim 1, wherein the controller is able to set a range of a predetermined upper shaft angle as a non-detection section, among the shaft angle sections where the sewing needle is not stuck into the cloth, and performs controls of maintaining the constant stitch length, by the movement amount of the fabric detected by the movement amount detector in a section where the sewing needle is excluded from the non-detection section is not stuck into the cloth.

3. The sewing machine according to claim 1, wherein free motion stitching is performed by manually moving the fabric with respect to a stitch position of the sewing machine.

4. The sewing machine according to claim 2, wherein free motion stitching is performed by manually moving the fabric with respect to a stitch position of the sewing machine.

5. The sewing machine according to claim 1, wherein the free motion stitching is performed by manually moving the sewing machine with respect to the fabric.

6. The sewing machine according to claim 2, wherein the free motion stitching is performed by manually moving the sewing machine with respect to the fabric.

* * * * *